US005933964A

United States Patent [19]

Altamore

[11] Patent Number: 5,933,964

[45] **Date of Patent: *Aug. 10, 1999**

[54] CUTTER BLADE FOR HAIR CLIPPERS

[75] Inventor: Nicolo Altamore, Rockford, Ill.

[73] Assignee: Wahl Clipper Corporation, Sterling, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/738,757

[22] Filed: Jul. 17, 1996

[51] Int. Cl.[6] ..... B26B 19/22

[52] U.S. Cl. ..... 30/195; 30/216; 30/223; 30/225

[58] Field of Search ..... 30/195, 210, 216, 30/223, 225

[56] References Cited

U.S. PATENT DOCUMENTS

| | | |
|---|---|---|
| D. 219,501 | 12/1970 | Trevor . |
| 251,621 | 4/1881 | Mestrovic et al. . |
| 1,158,741 | 11/1915 | Stearns et al. . |
| 1,780,276 | 11/1930 | Scheiwer . |
| 1,908,385 | 5/1933 | Wahl . |
| 1,939,253 | 12/1933 | Dremel . |
| 2,008,631 | 7/1935 | Udkovich . |
| 2,035,632 | 3/1936 | Andis . |
| 2,118,850 | 5/1938 | Marcel . |
| 2,165,391 | 7/1939 | Lewis . |
| 2,264,101 | 11/1941 | Strezoff . |
| 2,292,364 | 8/1942 | Cromonic . |
| 2,470,287 | 5/1949 | Carter . |
| 2,641,833 | 6/1953 | Need . |
| 2,718,693 | 9/1955 | Gent . |
| 2,726,441 | 12/1955 | Brody . |
| 2,746,144 | 5/1956 | Spanel . |
| 2,778,106 | 1/1957 | Hazelquist . |
| 2,790,283 | 4/1957 | Spencer . |
| 2,900,718 | 8/1959 | Bailey et al. . |
| 3,041,721 | 7/1962 | Quinio, Sr. . |
| 3,060,573 | 10/1962 | Clark . |
| 3,180,026 | 4/1965 | D'Amico . |
| 3,238,616 | 3/1966 | Eweson . |
| 3,391,459 | 7/1968 | Rollo . |
| 3,402,467 | 9/1968 | Manahan . |
| 3,421,213 | 1/1969 | Pawlikowski . |
| 3,523,364 | 8/1970 | Crisanti . |
| 3,536,080 | 10/1970 | Player et al. . |
| 3,571,928 | 3/1971 | Willey et al. . |
| 3,699,653 | 10/1972 | Miller . |
| 3,805,381 | 4/1974 | Broussard, Sr. . |

(List continued on next page.)

FOREIGN PATENT DOCUMENTS

| | | | |
|---|---|---|---|
| 70103 | 10/1949 | Denmark . | |
| 586500 | 10/1933 | Germany . | |
| 2800568 | 7/1978 | Germany | 30/225 |
| 2007575 | 5/1979 | United Kingdom . | |
| 1552752 | 9/1979 | United Kingdom . | |

*Primary Examiner*—Douglas D. Watts
*Attorney, Agent, or Firm*—Greer, Burns & Crain, Ltd.

[57] ABSTRACT

A clipper for cutting hair strands includes a blade set which has a stationary blade having a plurality of stationary blade teeth arranged a row so that hair strands enter between adjacent stationary teeth as the blade set moves through the hair strands. The stationary blade teeth have angled side cutting edges and tips, and the side cutting edges of adjacent teeth form roots where they intersect.

A moving blade has a plurality of moving blade teeth which are also arranged in a row. The moving blade teeth complement the stationary blade teeth and pass across the stationary blade teeth in use to cut some of the hair strands. The moving blade teeth are relatively short, and preferably have tips which are flat. The moving blade teeth are separated by blade-like edge surfaces which are oriented in the direction of movement of the moving blade and are capable of cutting some of the hair strands which enter between the stationary blade teeth. The knife-like blade edges form a first line which is between a second line formed by the stationary blade teeth roots and a third line formed by the stationary blade teeth tips.

5 Claims, 2 Drawing Sheets

U.S. PATENT DOCUMENTS 3,855,695 12/1974 Spanel .
3,885,305 5/1975 Spanel .
3,953,926 5/1976 Kallikounis .
3,999,295 12/1976 Du Bois .
4,118,863 10/1978 Sandy .
4,221,049 9/1980 Hamashima .
4,557,050 12/1985 Haraguchi et al. .
4,782,592 11/1988 Altamore .

CUTTER BLADE FOR HAIR CLIPPERS

This invention relates to cutting blades for hair clippers, and more particularly, to reciprocating cutting blades having short teeth with flat tips, and knife-like edges between teeth for obtaining unique hairstyles with hair clippers.

BACKGROUND OF THE INVENTION

Electric hair clippers have been used to cut hair for many years. The clippers generally include a blade set having a stationary blade and a moving blade. Each of the blades has a row of spaced teeth arranged so that hair strands which enter between the teeth of the stationary blade are cut when the teeth of the moving blade pass across the stationary blade teeth.

Conventional hair clippers cut hair quickly and efficiently, and are designed so that substantially all of the hair strands which pass between the stationary teeth are cut to a particular uniform length. This is undesirable when creating some hairstyles, however, such as when thinning the hair by only cutting a limited number of the hair strands. Other hairstyling effects, such as layering or blending the hair, cannot be made well with a conventional hair clipper, either, and are usually made by chopping the hair with a razor. This requires manual effort and special skill some possibility of injury. Thus, there is a need for hair clipper blades which can be used to create the appearance of razor cut hairstyles.

Accordingly, one object of this invention is to provide new and improved cutting blades for hair clippers.

Another object is to provide new and improved hair clipper cutting blades which can create the appearance of razor cut hairstyles by thinning, layering and blending the hair to create unique textures and surface appearances in the hair.

SUMMARY OF THE INVENTION

In keeping with one aspect of this invention, an electric hair clipper includes a case, a motor and a blade set. The blade set has a stationary blade having a row of spaced teeth, and a moving or reciprocating blade which also has a row of spaced teeth arranged so that some of the hair strands which enter between adjacent teeth of the stationary blade can be cut as the moving blade reciprocates in operation.

The tips of the teeth of the moving or cutting blade are preferably flat, and the teeth are relatively short in effective length. In addition, the moving teeth are spaced so that the distance between adjacent moving teeth is greater than the space between adjacent teeth on the stationary blade.

A knife-like edge is provided between adjacent moving teeth, and the moving blade is arranged so that the knife-like edges pass across the spaces between the stationary blade teeth. In this manner, razor cut hairstyles can be obtained with this invention.

BRIEF DESCRIPTION OF THE DRAWINGS

The above-mentioned and other features of the invention and the manner of obtaining them will become more apparent, and the invention itself will be best understood by reference to the following description of an embodiment of the invention taken in conjunction with the accompanying drawings, in which.

DETAILED DESCRIPTION

Figure 1:
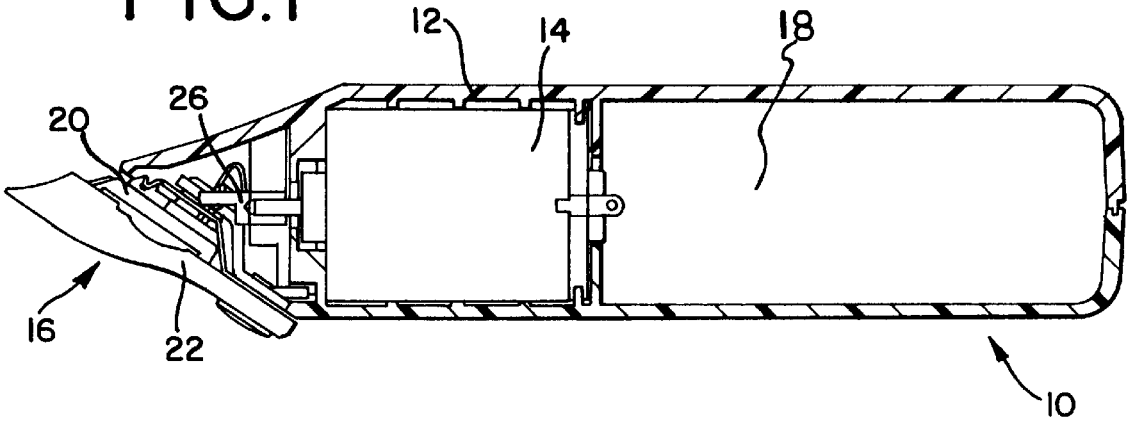
FIG. 1 is a diagram of the interior of a hair clipper.

As seen in the Figures, an electric hair clipper 10 includes a case 12, a motor 14, and a blade set 16. Electricity is supplied through a power supply 18, such as line voltage, batteries or the like.

The blade set 16 includes a moving blade 20 and a stationary blade 22. The moving blade 20 is pressed against the stationary blade 22 by a tension spring 24, which allows the cutting blade 22 to be moved back and forth in a reciprocating motion by an eccentric cam 26 which is also coupled connected to the motor 14.

The stationary blade 22 has a plurality of teeth 28 which are arranged in a row. The teeth 28 have angled side cutting edges 30 and a tip 32 at the end of each tooth 28 where the side cutting edges 30 intersect. Every other tip 32 preferably has short extension 31, and the remaining tips 32 have a long extension 33. The cutting edges 30 of adjacent teeth 28 form roots 34 where they intersect. The roots 34 lie along a generally straight line 36 which is transverse to the direction in which the hair clipper is passed through hair strands in use, and generally parallel to the direction A in which the moving blade 20 moves in operation.

The moving blade 20 includes a plurality of spaced teeth 38. The space between adjacent teeth 38 is greater than the space between adjacent stationary teeth 28. The teeth 38 have flat tips 40, and are separated by knife-like edges 42 formed by two surfaces 43, 45. The edges 42 are oriented in the direction A in which the moving blade reciprocates, and are sharp enough to cut a hair with a slicing action created by the moving blade, although actual razor sharpness is not needed.

Figure 7:
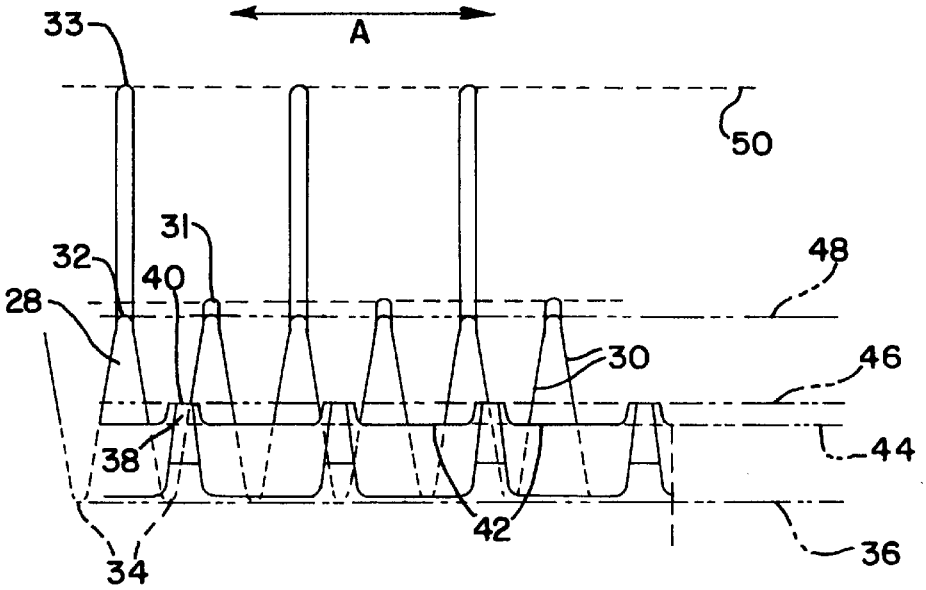
FIG. 7 is a diagram showing the relative relationships of parts of the cutting blade teeth and the stationary blade teeth.

The relationship among various parts of the teeth 28 and teeth 38 is shown in FIG. 7. A line 44 formed by the knife-like edges 42 is above the line 36, so that the knife-like edges 42 can cut some hair strands which pass between the stationary teeth 28. The tips 40 of the moving blade 20 lie along a line 46 which is above the lines 36 and 44, so the teeth 38 can cut some hair strands, as well. Generally, the knife-like edges 42 cut hair strands as they would be cut with a knife using a slicing action, and the teeth 38 cut with a shearing action similar to a conventional hair clipper. It is contemplated that in some cases the teeth 38 only partially cut some of the hair strands.

Figure 2:
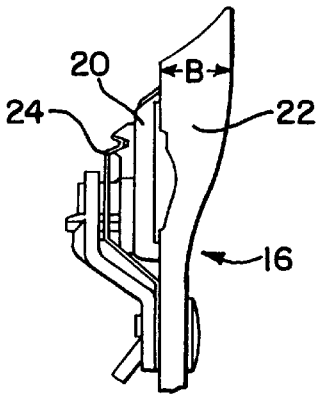
FIG. 2 is a side view of a blade set for the hair clipper shown in FIG. 1.
Figure 3:
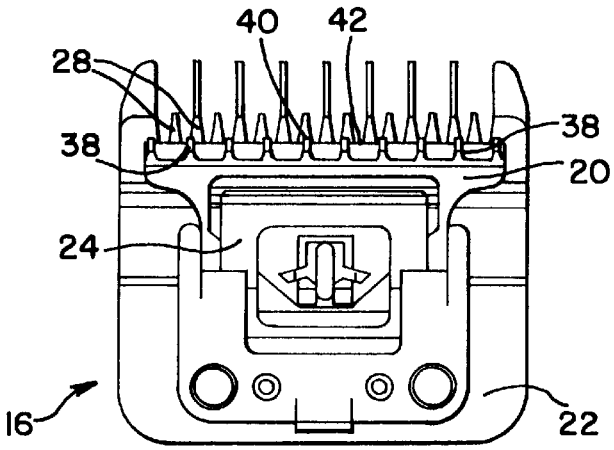
FIG. 3 is an inside view of the blade set of FIG. 1, showing a blade set made in accordance with the principles of this invention.
Figure 4:
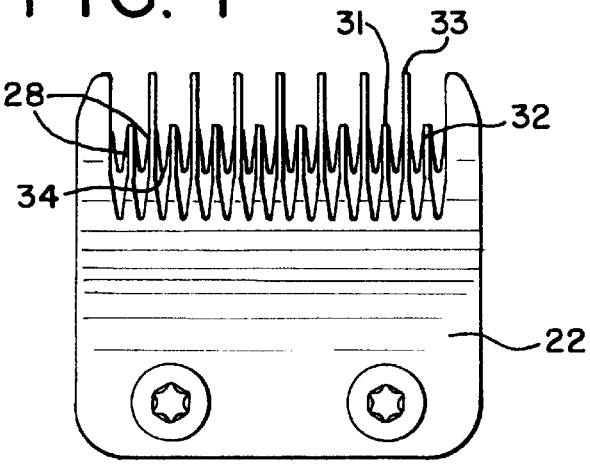
FIG. 4 is an outside view of the blade set of FIG. 1.
Figure 5:
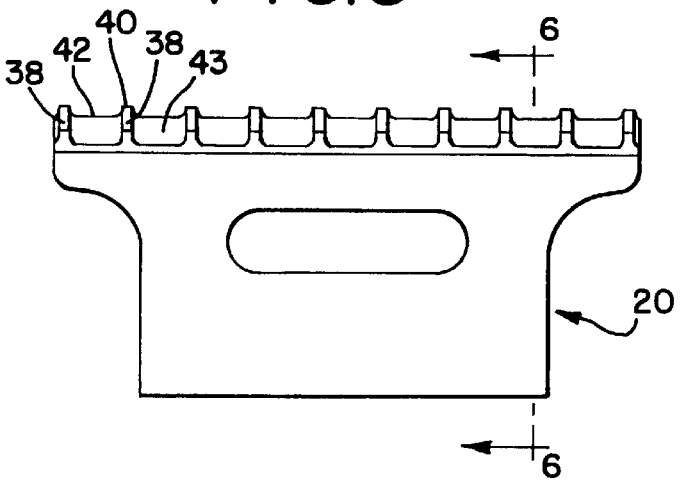
FIG. 5 is a top view of the cutting blade of the blade set of FIG. 1.
Figure 6:
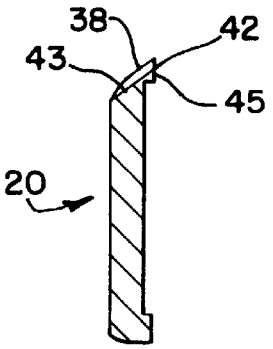
FIG. 6 is a cross-sectional view of the cutting blade of FIG. 5, taken along lines 6—6 in FIG. 5.

In one embodiment, the line 44 was about 0.07 inches above the line 36, and the line 46 was about 0.02 inches above the line 44. The tips 32 followed along a line 48, which in that embodiment was about 0.2 inches above the line 36. The typical distance between adjacent tips 32 was about 0.095 inches and the center-to-center distance between teeth 38 was about 0.17 inches. The amplitude of the stroke was about 0.110 inches. The short tip extensions 31 were located along a line 50 which was about 0.220 inches above the line 36, and the tips extensions 33 were located along a line 52 which was about 0.46 inches above the line 36. The tips extensions 33 were about 0.3 inches wide at B in FIG. 2. Razor style hair designs were obtained using these dimensions, although other dimensions are contemplated particularly dimensions having some or all of the relative proportions defined by these dimensions.

In use, the hair clipper is used in an ordinary manner. However, the clipper is moved in a direction which allows the knife-like edges 42 to cut some hair strands, while the moving teeth 38 cut other hair strands. The angle of approach to the strands affects the rate of cutting by the moving blade. The teeth 38 do not cut the hair strands in exactly the same manner as the edges 42, however, which creates a new and unique clipper cut hairstyle similar in appearance to the style obtained with a razor. Other styles are also contemplated.

The advantages of this invention are now apparent. Razor cut hairstyles involving thinning, layering, texturing and blending the hair can be obtained with an electric hair clipper, eliminating the manual effort required when using a razor blade, and reducing the likelihood of injury. Less skill is required, and unique, uniform hair designs are obtained.

While the principles of the invention have been described above in connection with specific apparatus and applications, it is to be understood that this description is made only by way of example and not as a limitation on the scope of the invention.

What is claimed is:

1. A clipper for cutting hair strands comprising a case, a motor secured inside said case, power means for operating said motor, and a blade set secured to said case for cutting the hair strands, said blade set being operated by said motor, said blade set including a stationary blade having a plurality of stationary blade teeth arranged in a row so that hair strands enter between adjacent stationary teeth as the blade set moves through the hair strands, said stationary blade teeth having side cutting edges and a tip, said stationary blade teeth having roots between said side cutting edges of adjacent teeth, and a moving blade having a plurality of moving blade teeth arranged in a row, said moving blade teeth complementing said stationary blade teeth and passing across said cutting edges of said stationary blade teeth in use to cut some of the hair strands in a shearing action, said moving blade teeth being separated by surfaces, said surfaces forming sharpened, forward angled knife-like moving blade edges oriented in the direction of movement of said moving blade, said knife-like moving blade edges forming a first line which is between a second line formed by said stationary blade teeth roots and a third line formed by said stationary blade teeth tips, said knife-like, sharpened moving blade edges being sharp enough to cut hair with a slicing action created by said moving blade reciprocating relative to said fixed blade to create a razor cut hairstyle said blades being configured so that said slicing action of said sharpened surfaces occurs simultaneously with said shearing action.

2. A blade set for cutting hair strands comprising a stationary blade having a plurality of stationary blade teeth arranged in a row so that hair strands enter between adjacent stationary teeth as the blade set moves through the hair strands, said stationary blade teeth having side cutting edges and a tip, said stationary blade teeth having roots between said side cutting edges of adjacent teeth, and a moving blade having a plurality of moving blade teeth arranged in a row, said moving blade teeth complementing said stationary blade teeth and passing across said cutting edges of said stationary blade teeth in use to cut some of the hair strands in a shearing action, said moving blade teeth being separated by surfaces, said surfaces forming sharpened, forward angled knife-like moving blade edges oriented in the direction of movement of said moving blade and capable of cutting some of the hair strands which enter between said stationary blade teeth said knife-like moving blade edges forming a first line which is between a second line formed by said stationary blade teeth roots and a third line formed by said stationary blade teeth tips, said sharpened knife-like, moving blade edges being sharp enough to cut hair with a slicing action created by said moving blade reciprocating relative to the fixed blade to create a razor cut hairstyle, said blades being configured so that said slicing action of said sharpened edges occurs simultaneously with said shearing action.

3. A clipper for cutting hair strands comprising a case, a motor secured inside said case, power means for operating said motor, and a blade set secured to said case for cutting the hair strands, said blade set being operated by said motor, said blade set including a stationary blade having a plurality of stationary blade teeth arranged in a row so that hair strands enter between adjacent stationary teeth as the blade set moves through the hair strands, said stationary blade teeth each having side cutting edges and a tip, said stationary blade teeth having roots between said side cutting edges of adjacent teeth, and a moving blade having a plurality of moving blade teeth arranged in a row, said moving blade teeth complementing said stationary blade teeth and passing across said cutting edges of said stationary blade teeth in use to cut some of the hair strands in a shearing action, said moving blade teeth being separated by surfaces, said surfaces forming sharpened, forward angled knife-like moving blade edges oriented in the direction of movement of said moving blade and capable of cutting some of the hair strands which enter between said stationary blade teeth said knife-like moving blade edges forming a first line which is between a second line formed by said stationary blade teeth roots and a third line formed by said stationary blade teeth tips, said sharpened, knife-like, moving blade edges being sharp enough to cut hair with a slicing action created by the moving blade reciprocating relative to the fixed blade to create a razor cut hairstyle, said blades being configured so that said slicing action of said sharpened edges occurs simultaneously with said shearing action.

4. A blade set for cutting hair strands comprising a stationary blade having a plurality of stationary blade teeth arranged in a row so that hair strands enter between adjacent stationary teeth as the blade set moves through the hair strands, said stationary blade teeth each having side cutting edges and a tip said stationary blade teeth having roots between said side cutting edges of adjacent teeth, and a moving blade having a plurality of moving blade teeth arranged in a row, said moving blade teeth complementing said stationary blade teeth and passing across said cutting edges of said stationary blade teeth in use to cut some of the hair strands in a shearing action, said moving blade teeth being separated by surfaces, said surfaces forming sharpened, forward angled, knife-like moving blade edges oriented in the direction of movement of said moving blade, said knife-like moving blade edges forming a first line which is between a second line formed by said stationary blade teeth roots and a third line formed by said stationary blade teeth tips, said sharpened, knife-like, moving blade edges being sharp enough to cut hair with a slicing action created by the moving blade reciprocating relative to said fixed blade to create a razor cut hairstyle, said blades being configured so that said slicing action occurs simultaneously with said shearing action.

5. A clipper for cutting hair strands comprising:

a case, a motor, and a blade set including a stationary blade having a row of spaced teeth and a moving blade having a row of spaced teeth, a sharpened, forward angled, knife-like edge extending between adjacent teeth of said moving blade, the location of said moving blade being such that said knife-like edges pass across spaces between said teeth of said stationary blade, said moving blade being constructed and arranged so that said sharpened knife-like moving blade edges are sharp enough to cut hair with a slicing action created by said moving blade reciprocating relative to said fixed blade and in addition to said shearing action between said moving blade and said stationary blade such that some of the hair strands which enter between adjacent teeth of the stationary blade can be cut to achieve a razor cut hairstyle as the moving blade reciprocates.

* * * * *